US011577509B2

(12) United States Patent
Tamai et al.

(10) Patent No.: US 11,577,509 B2
(45) Date of Patent: Feb. 14, 2023

(54) LIQUID EJECTING HEAD AND LIQUID EJECTING APPARATUS

(71) Applicant: SEIKO EPSON CORPORATION, Tokyo (JP)

(72) Inventors: Shotaro Tamai, Matsumoto (JP); Yuma Fukuzawa, Matsumoto (JP); Shohei Mizuta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 24 days.

(21) Appl. No.: 17/188,689

(22) Filed: Mar. 1, 2021

(65) Prior Publication Data

US 2021/0276328 A1 Sep. 9, 2021

(30) Foreign Application Priority Data

Mar. 4, 2020 (JP) ..... JP2020-036628

(51) Int. Cl.
*B41J 2/14* (2006.01)
*B41J 2/045* (2006.01)

(52) U.S. Cl.
CPC ..... *B41J 2/14201* (2013.01); *B41J 2/04581* (2013.01); *B41J 2002/14306* (2013.01); *B41J 2202/12* (2013.01)

(58) Field of Classification Search
CPC ..... B41J 2/14
See application file for complete search history.

(56) References Cited

U.S. PATENT DOCUMENTS

2003/0156166 A1* 8/2003 Sakaida ..... B41J 2/14209 347/68
2007/0229603 A1* 10/2007 Sugahara ..... B41J 2/14209 347/65
2011/0134174 A1* 6/2011 Seto ..... B41J 2/04581 347/10
2013/0088545 A1* 4/2013 Park ..... B41J 2/14233 347/44
2019/0224972 A1* 7/2019 Kuramochi ..... B41J 2/14201
2019/0299609 A1* 10/2019 Sugiura ..... B41J 2/14209

FOREIGN PATENT DOCUMENTS

JP 2001030483 A * 2/2001
JP 2002283562 A * 10/2002
JP 3809787 B2 * 8/2006 ..... B41J 2/14209
JP 2019-147303 9/2019

* cited by examiner

*Primary Examiner* — Shelby L Fidler
(74) *Attorney, Agent, or Firm* — Workman Nydegger

(57) ABSTRACT

A liquid ejecting head includes: a pressure chamber substrate; and a communication plate, in which the pressure chamber substrate includes a first pressure chamber that extends in a first direction and applies pressure to a liquid, and a first supply channel, and the communication plate includes a first communication channel that extends in a second direction intersecting with the first direction and communicates with the first supply channel, and a second supply channel that communicates with the first supply channel and the first pressure chamber.

17 Claims, 8 Drawing Sheets

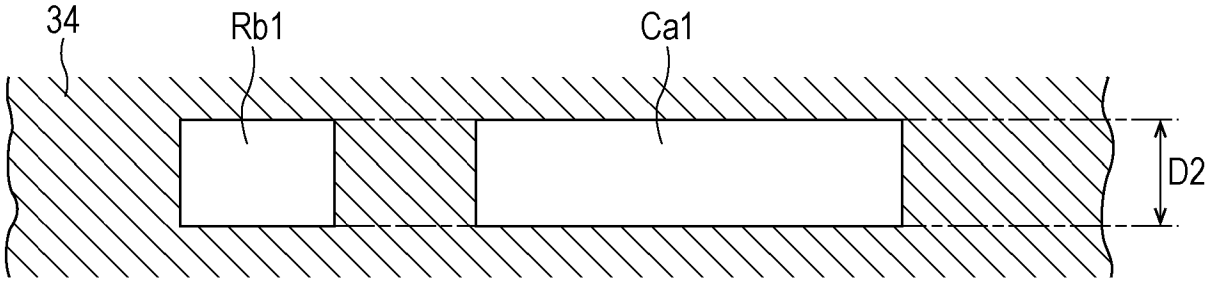
FIG. 4A
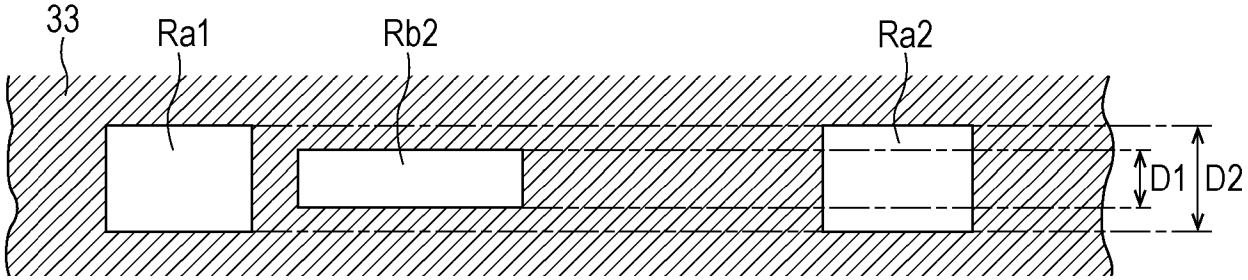
FIG. 4B
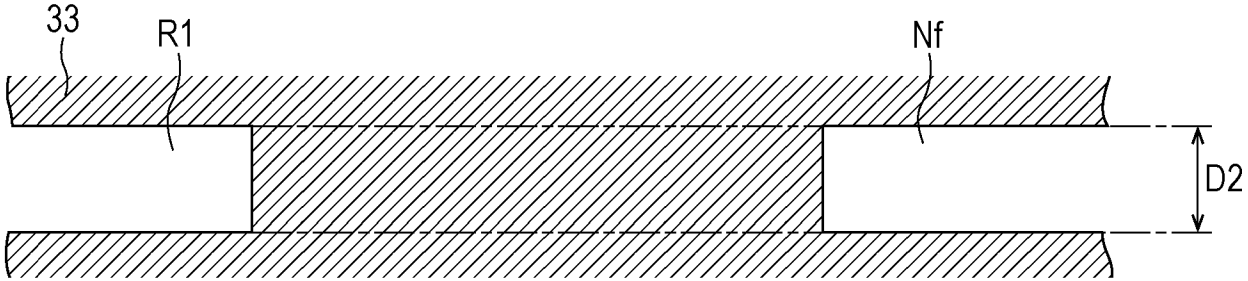
FIG. 4C
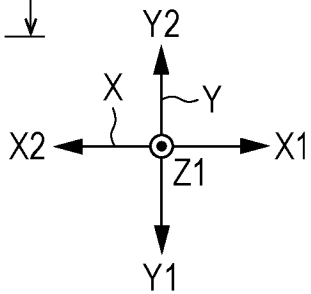

34
35
Rb1
Rb2
33
361
h1
h2
h3
Z1
Z2
Y1
Y2
X1
Z
Y

Re1
Re2
35
34
33
361
h5
h4
h3
Z1
Z2
Y1
Y2
X1
Z
Y

LIQUID EJECTING HEAD AND LIQUID EJECTING APPARATUS

The present application is based on, and claims priority from JP Application Serial Number 2020-036628, filed Mar. 4, 2020, the disclosure of which is hereby incorporated by reference herein in its entirety.

BACKGROUND

1. Technical Field

The present disclosure relates to a liquid ejecting head and a liquid ejecting apparatus.

2. Related Art

Liquid ejecting heads that eject liquid such as ink from a plurality of nozzles have been proposed. For example, JP-A-2019-147303 discloses a liquid ejecting head that causes a piezoelectric element to change the pressure of a liquid in a pressure chamber and thereby ejects the liquid from a nozzle provided in a channel that communicates with the pressure chamber. The liquid ejecting head is a so-called circulation type that causes the liquid to circulate. That is, the liquid ejecting head takes the liquid from one channel, which communicates with the pressure chamber, and supplies the liquid from another channel to a channel in which the nozzle is provided.

SUMMARY

The disclosure provides a liquid ejecting head that includes a supply port capable of individually adjusting inertance and channel resistance.

To address the aforementioned problem, a liquid ejecting head according to a suitable aspect of the disclosure includes a pressure chamber substrate, and a communication plate, in which the pressure chamber substrate includes a first pressure chamber that extends in a first direction and applies pressure to a liquid and a first supply channel, and the communication plate includes a first communication channel that extends in a second direction intersecting with the first direction and communicates with the first supply channel, and a second supply channel that communicates with the first supply channel and the first pressure chamber.

BRIEF DESCRIPTION OF THE DRAWINGS

FIGS. 4A to 4C are sectional views illustrating a configuration of an individual channel and the like.

FIGS. 5A to 5C are sectional views illustrating a configuration of the individual channel and the like.

FIGS. 7A to 7C are sectional views illustrating an individual channel and the like.

FIGS. 8A to 8C are sectional views illustrating the individual channel and the like.

DESCRIPTION OF EXEMPLARY EMBODIMENTS

A: First Embodiment

Figure 1:
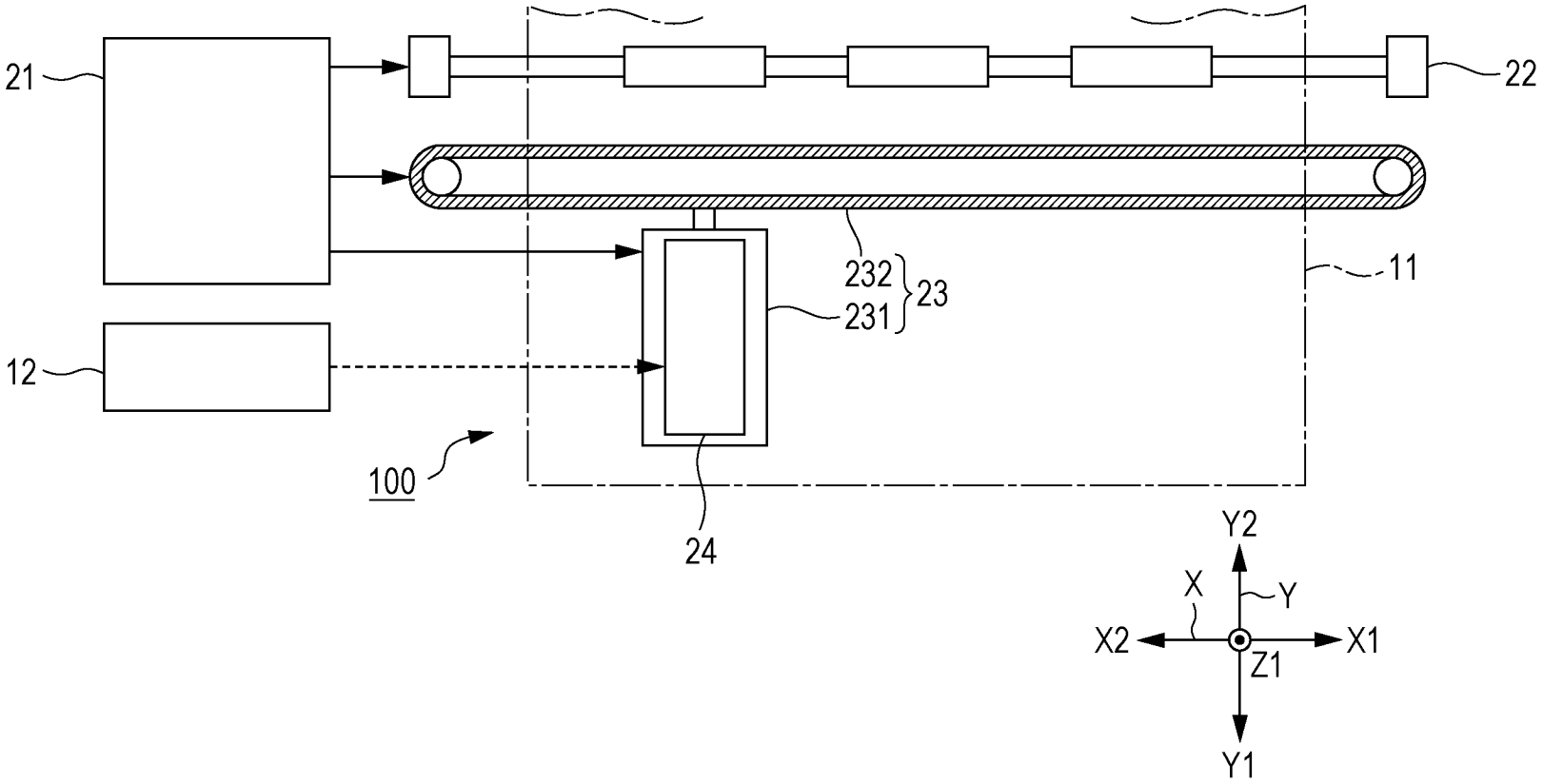
FIG. 1 is a schematic view illustrating an example of a partial configuration of a liquid ejecting apparatus according to a first embodiment.

In the following description, the X-axis, the Y-axis, and the Z-axis that intersect each other are assumed. The X-axis, the Y-axis, and the Z-axis are common to all the drawings exemplified in the following description. As illustrated in FIG. 1, a direction along the X-axis as viewed from a certain point is expressed as direction X1, and a direction opposite to direction X1 is expressed as direction X2. Direction X2 corresponds to "a first direction". Similarly, directions opposite to each other along the Y-axis as viewed from a certain point are expressed as direction Y1 and direction Y2. Direction Y2 corresponds to "a third direction". Directions opposite to each other along the Z-axis as viewed from a certain point are expressed as direction Z1 and direction Z2. Direction Z1 corresponds to "a second direction". An X-Y plane that extends along the X-axis and the Y-axis corresponds to a horizontal plane. The Z-axis is an axis extending in the up-down direction, and direction Z2 corresponds to the down direction of the up-down direction.

FIG. 1 is a schematic view illustrating an example of a partial configuration of a liquid ejecting apparatus 100 according to a first embodiment. The liquid ejecting apparatus 100 is an ink jet printing apparatus that ejects droplets of liquid such as ink onto a medium 11. The medium 11 is, for example, a printing sheet. The medium 11 may be, for example, a printing object made from any material such as a resin film or fabric.

The liquid ejecting apparatus 100 includes a liquid container 12. The liquid container 12 accumulates ink. The liquid container 12 may be, for example, a cartridge detachably attachable to the liquid ejecting apparatus 100, a bag-like ink pack formed from a flexible film, or an ink tank that is able to be replenished with ink. Note that the liquid container 12 accumulates any type of ink.

As illustrated in FIG. 1, the liquid ejecting apparatus 100 includes a control unit 21, a transport mechanism 22, a moving mechanism 23, and a liquid ejecting head 24. The control unit 21 includes, for example, a processing circuit such as a central processing unit (CPU) or field programmable gate array (FPGA) and a storage circuit such as semiconductor memory and controls respective elements of the liquid ejecting apparatus 100, such as ejection operation of the liquid ejecting head 24. The control unit 21 is an example of "a control section".

The transport mechanism 22 transports the medium 11 in the Y-axis direction based on control of the control unit 21. The moving mechanism 23 causes the liquid ejecting head 24 to be reciprocated in the X-axis direction based on control of the control unit 21. The moving mechanism 23 includes a transport body 231 that is substantially box shaped and that houses the liquid ejecting head 24 and an endless transport belt 232 to which the transport body 231 is fixed. Note that the first embodiment can adopt a configuration in which a plurality of liquid ejecting heads 24 are mounted on the transport body 231 or a configuration in which the liquid container 12 is mounted on the transport body 231 together with the liquid ejecting head 24.

The liquid ejecting head 24 ejects the ink, which is supplied from the liquid container 12, from a plurality of nozzles onto the medium 11 based on control of the control unit 21. In conjunction with transport of the medium 11 by the transport mechanism 22 and repetitive reciprocation of the transport body 231, the liquid ejecting head 24 ejects the ink onto the medium 11 to thereby form an image on the surface of the medium 11.

Figure 2:
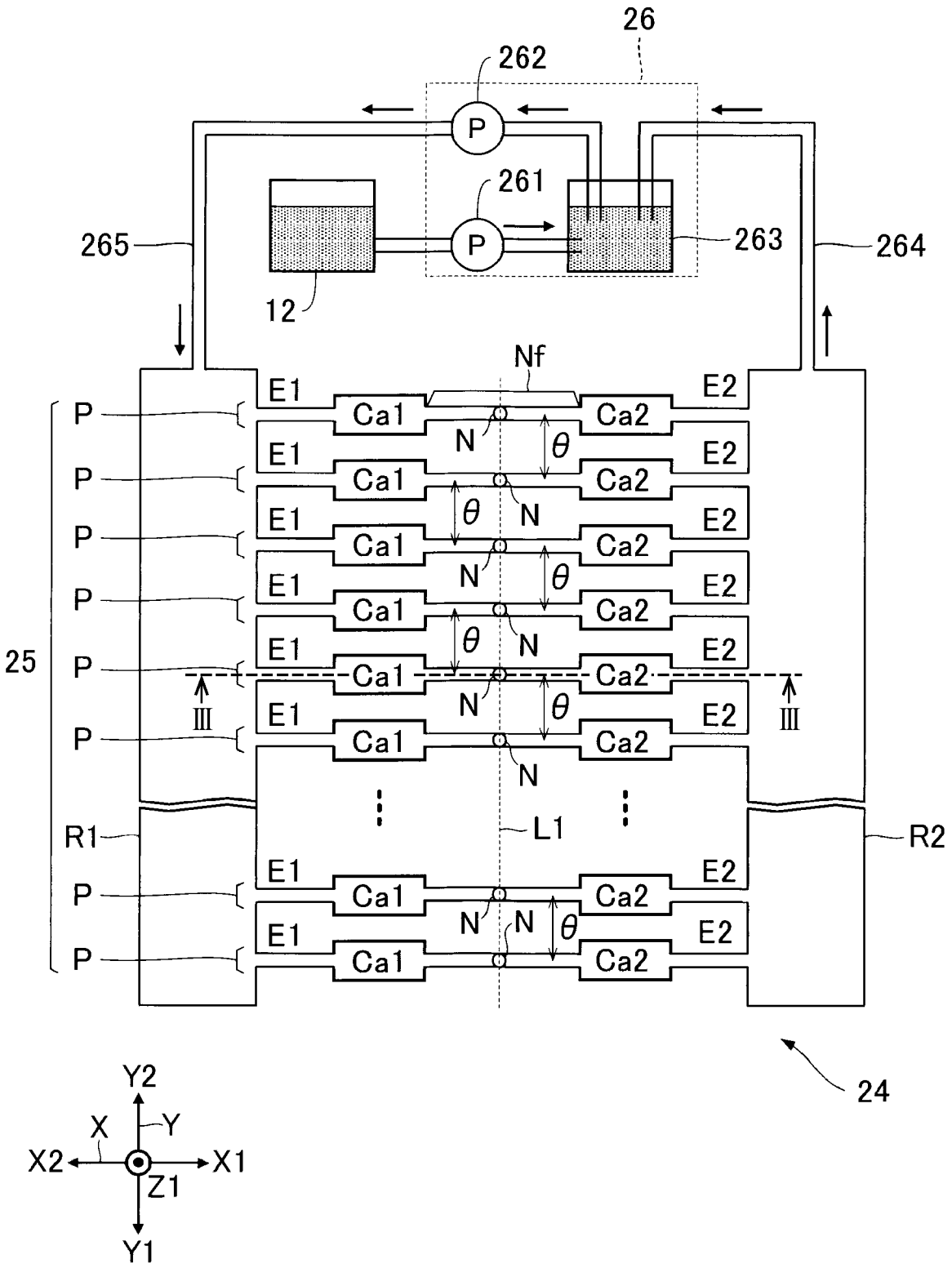
FIG. 2 is a schematic view illustrating a channel structure of a liquid ejecting head.

FIG. 2 is a schematic view illustrating a channel structure of the liquid ejecting head 24 when the liquid ejecting head 24 is viewed in the Z-axis direction. As illustrated in FIG. 2, a plurality of nozzles N are formed at the surface of the liquid ejecting head 24, which faces the medium 11. The plurality of nozzles N are arrayed in the Y-axis direction. The plurality of nozzles N each eject the ink in the Z-axis direction. A nozzle N is an example of "a nozzle".

As illustrated in FIG. 2, the plurality of nozzles N are positioned on the same straight line and constitute a nozzle row L1. The nozzle row L1 is a set of the plurality of nozzles N that are arrayed on the straight line in the Y-axis direction. As illustrated in FIG. 2, the nozzles N are arrayed at a pitch θ. The pitch θ is a distance between the center of a nozzle N and the center of another adjacent nozzle N in the Y-axis direction.

As illustrated in FIG. 2, the liquid ejecting head 24 includes an individual channel row 25. The individual channel row 25 is a set of a plurality of individual channels P. The plurality of individual channels P extend in direction X1 and correspond to nozzles N that differ from each other. The plurality of individual channels P communicate with the nozzles N. As illustrated in FIG. 2, the plurality of individual channels P are adjacent to each other in the Y-axis direction. A detailed configuration of the individual channels P will be described later. Note that the term "adjacent" described above means that at least a portion of a certain element A and at least a portion of a certain element B face each other when the element A and the element B are viewed in a specific direction. It is not necessary that the entire element A and the entire element B face each other, and a state where at least a portion of the element A and at least a portion of the element B face each other is considered as a state where the element A and the element B are "adjacent" to each other.

As illustrated in FIG. 2, an individual channel P includes a pressure chamber Ca1 and a pressure chamber Ca2. The pressure chamber Ca1 and the pressure chamber Ca2 of the individual channel P extend in direction X1. The pressure chamber Ca1 and the pressure chamber Ca2 accumulate the ink to be ejected from the nozzle N that communicates with the individual channel P. When pressure in the pressure chamber Ca1 and the pressure chamber Ca2 changes, the ink is ejected from the nozzle N. The pressure chamber Ca1 is an example of "a first pressure chamber", and the pressure chamber Ca2 is an example of "a second pressure chamber". Note that, in the following description, when there is no particular necessity to distinguish between the pressure chamber Ca1 and the pressure chamber Ca2, they are simply expressed as "pressure chambers C".

As illustrated in FIG. 2, the liquid ejecting head 24 includes a first common liquid chamber R1 and a second common liquid chamber R2. Each of the first common liquid chamber R1 and the second common liquid chamber R2 extends in the Y-axis direction over an entire region in which the plurality of nozzles N are distributed. The individual channel row 25 and the plurality of nozzles N are positioned between the first common liquid chamber R1 and the second common liquid chamber R2 in plan view in the Z-axis direction. In the following description, the plan view in the Z-axis direction is simply referred to as "plan view".

The plurality of individual channels P communicate with the first common liquid chamber R1 in common. Specifically, an end E1 of each of the individual channels P in direction X2 is coupled to the first common liquid chamber R1. Similarly, the plurality of individual channels P communicate with the second common liquid chamber R2 in common. Specifically, an end E2 of each of the individual channels P in direction X1 is coupled to the second common liquid chamber R2. In the liquid ejecting head 24, the individual channels P enable the first common liquid chamber R1 and the second common liquid chamber R2 to communicate with each other. Thereby, the ink supplied from the first common liquid chamber R1 to the respective individual channels P is ejected from the nozzles N. Ink that is not ejected is discharged to the second common liquid chamber R2.

As illustrated in FIG. 2, the liquid ejecting head 24 includes a circulation mechanism 26. The circulation mechanism 26 is a mechanism that causes the ink discharged from the respective individual channels P to the second common liquid chamber R2 to return to the first common liquid chamber R1. The circulation mechanism 26 includes a first supply pump 261, a second supply pump 262, an accumulation container 263, a circulation channel 264, and a supply channel 265.

The first supply pump 261 is a pump that supplies the ink accumulated in the liquid container 12 to the accumulation container 263. The accumulation container 263 is a temporary storage tank that temporarily stores the ink supplied from the liquid container 12.

The circulation channel 264 is a channel that enables the second common liquid chamber R2 and the accumulation container 263 to communicate with each other and is used to discharge the ink from a third communication channel Ra3 described later via the second common liquid chamber R2.

The ink accumulated in the liquid container 12 is supplied from the first supply pump 261 to the accumulation container 263, and the ink discharged from the respective individual channels P to the second common liquid chamber R2 is also supplied to the accumulation container 263 via the circulation channel 264.

The second supply pump 262 is a pump that discharges the ink accumulated in the accumulation container 263. The ink discharged from the second supply pump 262 is supplied to the first common liquid chamber R1 via the supply channel 265. The supply channel 265 is used to supply the ink to a first communication channel Ra1 described later.

As illustrated in FIG. 2, the individual channel P includes a nozzle channel Nf. The nozzle channel Nf extends in direction X1 and is positioned between the pressure chamber Ca1 and the pressure chamber Ca2 as viewed in the Z-axis direction as illustrated in FIG. 2. The nozzle channel Nf communicates with the pressure chamber Ca1 and the pressure chamber Ca2 and includes the nozzle N for ejecting the ink supplied from the pressure chamber Ca1.

In the liquid ejecting head 24 of the first embodiment, as illustrated in FIG. 2, pressure chambers Ca1 and pressure chambers Ca2 corresponding to different nozzles N of the nozzle row L1 are aligned on the straight line in the Y-axis direction. As illustrated in FIG. 2, an array constituted by the plurality of pressure chambers Ca1 and an array constituted by the plurality of pressure chambers Ca2 are arranged side by side with a given gap therebetween in the X-axis direction. The position of each of the pressure chambers Ca1 in the Y-axis direction and the position of each of the pressure chambers Ca2 in the Y-axis direction are typically the same.

Figure 3:
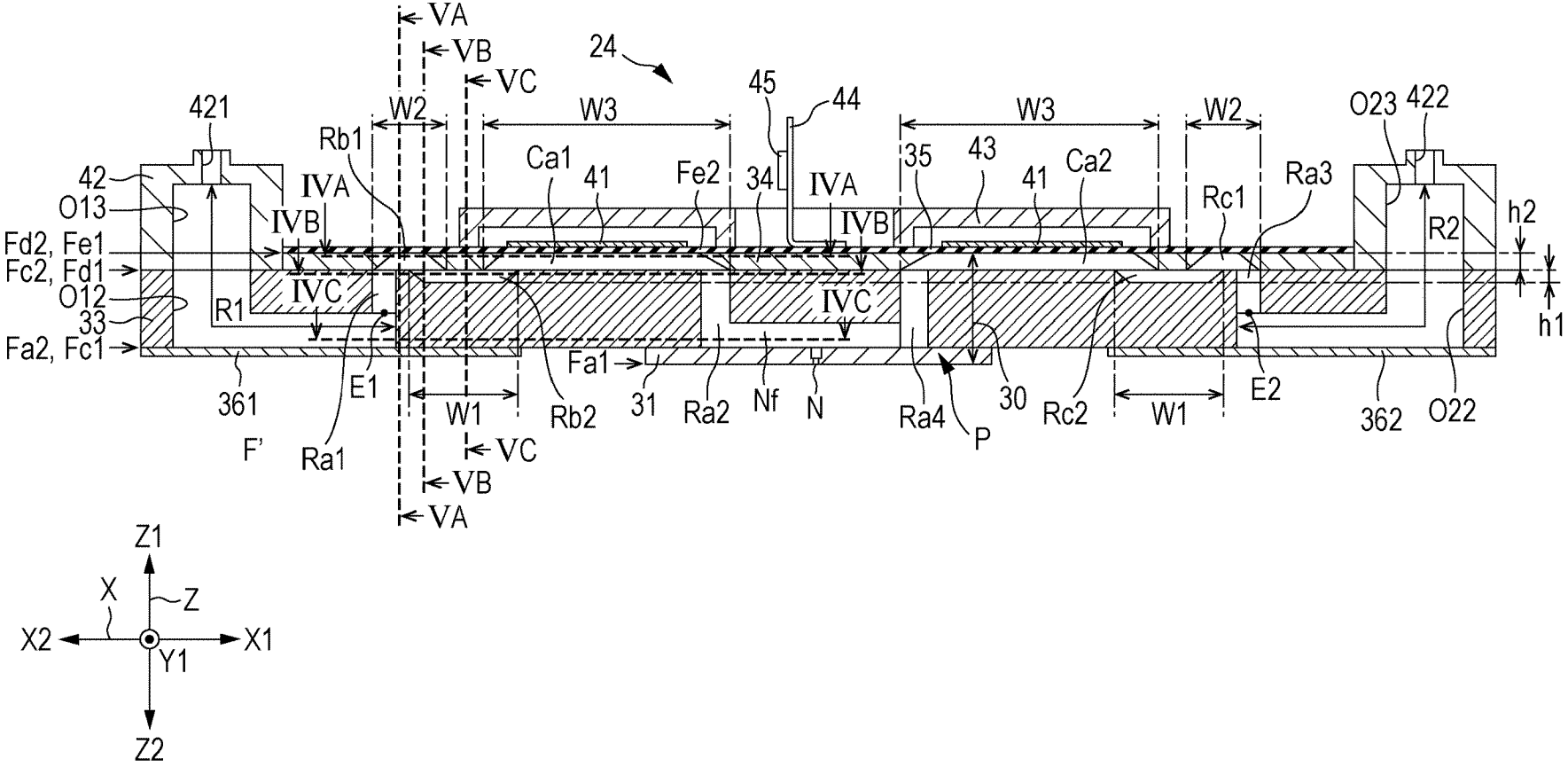
FIG. 3 is a sectional view along line in FIG. 2.

Next, a detailed configuration of the liquid ejecting head 24 will be described. FIG. 3 is a sectional view along line III-III in FIG. 2. FIG. 3 illustrates a section passing through the individual channel P. As illustrated in FIG. 3, the liquid ejecting head 24 includes a channel structure 30, a plurality of piezoelectric elements 41, a housing 42, a protection substrate 43, and a wiring substrate 44.

The channel structure 30 is a structure in which a channel having the first common liquid chamber R1, the second common liquid chamber R2, the plurality of individual channels P, and the plurality of nozzles N is formed. The channel structure 30 is a structure in which a nozzle substrate 31, a communication plate 33, a pressure chamber substrate 34, and a vibrating plate 35 are layered in order toward direction Z1. The elements that constitute the channel structure 30 are each manufactured such that, for example, a silicon monocrystalline substrate is processed by using a general processing method for manufacturing a semiconductor.

The plurality of nozzles N are formed in the nozzle substrate 31. The plurality of nozzles N are through holes each of which has a cylindrical shape and enables the ink to pass therethrough. As illustrated in FIG. 3, the nozzle substrate 31 is a plate member that has a surface Fa1 facing direction Z2 and a surface Fa2 facing direction Z1. The communication plate 33 is a plate member that has a surface Fc1 facing direction Z2 and a surface Fc2 facing direction Z1.

The elements that constitute the channel structure 30 are each formed into a rectangular shape, which is elongated in the Y-axis direction, and are bonded to each other, for example, with an adhesive. For example, the surface Fa2 of the nozzle substrate 31 is bonded to the surface Fc1 of the communication plate 33, and the surface Fc2 of the communication plate 33 is bonded to a surface Fd1 of the pressure chamber substrate 34. A surface Fd2 of the pressure chamber substrate 34 is bonded to a surface Fe1 of the vibrating plate 35.

A space O12 and a space O22 are formed in the communication plate 33. The space O12 and the space O22 are openings that are elongated in the Y-axis direction. As illustrated in FIG. 3, the space O12 is a reservoir that extends in direction X1 and that accumulates the ink discharged from the supply channel 265. As illustrated in FIG. 3, the space O22 is a reservoir that extends in direction X1 and that accumulates the ink supplied from the third communication channel Ra3 described later. A vibration absorber 361 that closes the space O12 and a vibration absorber 362 that closes the space O22 are disposed on the surface Fc1 of the communication plate 33. The vibration absorber 361 and the vibration absorber 362 are layer members formed of an elastic material.

The housing 42 is a case for accumulating the ink. The housing 42 is bonded to the surface Fc2 of the communication plate 33. A space O13 that communicates with the space O12 and a space O23 that communicates with the space O22 are formed in the housing 42. The space O13 and the space O23 are spaces that are elongated in the Y-axis direction. The space O12 and the space O13 communicate with each other to constitute the first common liquid chamber R1. Similarly, the space O22 and the space O23 communicate with each other to constitute the second common liquid chamber R2. The vibration absorber 361 constitutes a wall surface of the first common liquid chamber R1 and absorbs a change in the pressure of the ink in the first common liquid chamber R1. The vibration absorber 362 constitutes a wall surface of the second common liquid chamber R2 and absorbs a change in the pressure of the ink in the second common liquid chamber R2.

A supply port 421 and a discharge port 422 are formed in the housing 42. The supply port 421 is a pipeline, which communicates with the first common liquid chamber R1, and is coupled to the supply channel 265 of the circulation mechanism 26. The ink discharged from the second supply pump 262 to the supply channel 265 is supplied to the first common liquid chamber R1 via the supply port 421. On the other hand, the discharge port 422 is a pipeline, which communicates with the second common liquid chamber R2, and is coupled to the circulation channel 264 of the circulation mechanism 26. The ink in the second common liquid chamber R2 is supplied to the circulation channel 264 via the discharge port 422.

The pressure chamber Ca1 and the pressure chamber Ca2 are provided in the pressure chamber substrate 34. Each of the pressure chambers C is a void between the surface Fc2 of the communication plate 33 and the vibrating plate 35. Each of the pressure chambers C is formed so as to be elongated in the X-axis direction in plan view and extends in direction X1.

The vibrating plate 35 is a plate member capable of elastically vibrating. The vibrating plate 35 is constituted by, for example, stacking a first layer made of silicon oxide ($SiO_2$) and a second layer made of zirconium oxide ($ZrO_2$). Note that the vibrating plate 35 and the pressure chamber substrate 34 may be integrally formed by a plate member of a given thickness, from which some region corresponding to a pressure chamber C in the thickness direction is selectively removed. Moreover, the vibrating plate 35 may be formed by a single layer.

The plurality of piezoelectric elements 41 corresponding to different pressure chambers C are disposed on a surface Fe2 of the vibrating plate 35. The piezoelectric elements 41 corresponding to the respective pressure chambers C overlap the pressure chambers C in plan view. Specifically, each of the piezoelectric elements 41 is constituted by stacking a first electrode and a second electrode that face each other with a piezoelectric layer formed between both the electrodes. The piezoelectric element 41 is an energy-generating element that changes the pressure of the ink in the pressure chamber C to thereby eject the ink in the pressure chamber C from the nozzle N. On receiving a driving signal, the piezoelectric element 41 causes the piezoelectric element 41 to deform and thereby causes the vibrating plate 35 to vibrate. When the vibrating plate 35 vibrates, the pressure chamber C expands and contracts. When the pressure chamber C expands and contracts, the pressure is applied from the pressure chamber C to the ink. Thereby, the ink is ejected from the nozzle N.

The protection substrate 43 is a plate member, which is disposed on the surface Fe2 of the vibrating plate 35, and protects the plurality of piezoelectric elements 41 and reinforces the mechanical strength of the vibrating plate 35. The plurality of piezoelectric elements 41 are housed between the protection substrate 43 and the vibrating plate 35. The wiring substrate 44 is mounted on the surface Fe2 of the vibrating plate 35. The wiring substrate 44 is a mounting component for electrically coupling the control unit 21 and the liquid ejecting head 24. For example, a flexible wiring substrate 44, such as a flexible printed circuit (FPC) or flexible flat cable (FFC), is suitably used. A drive circuit 45 for supplying a driving signal to each of the piezoelectric elements 41 is mounted on the wiring substrate 44.

Next, the configuration of the individual channel P will be described. As illustrated in FIG. 3, the individual channel P has the first communication channel Ra1, a first supply channel Rb1, a second supply channel Rb2, the pressure chamber Ca1, a second communication channel Ra2, the nozzle channel Nf, a fourth communication channel Ra4, the pressure chamber Ca2, a second discharge channel Rc2, a first discharge channel Rc1, and the third communication channel Ra3. The individual channel P is a channel in which the aforementioned elements are integrally formed and coupled in this order. The individual channel P is a channel in which a channel extending from the first communication channel Ra1 to the nozzle N and a channel extending from the nozzle N to the third communication channel Ra3 are formed to be plane symmetric with respect to a plane parallel to the Y-Z plane.

The first communication channel Ra1 is a space formed in the communication plate 33. Specifically, as illustrated in FIG. 3, the first communication channel Ra1 extends, in the Z-axis direction, from the space O12 that constitutes the first common liquid chamber R1 to the surface Fc2 of the communication plate 33. An end of the first communication channel Ra1, which is coupled to the space O12, is the end E1 of the individual channel P. The first communication channel Ra1 is a channel that communicates with the first supply channel Rb1 and that guides, to the first supply channel Rb1, the ink supplied from the first common liquid chamber R1.

As illustrated in FIG. 3, the first supply channel Rb1 is provided in the pressure chamber substrate 34. The first supply channel Rb1 is a space between the surface Fc2 of the communication plate 33 and the vibrating plate 35. The first supply channel Rb1 is a channel that communicates with the first communication channel Ra1 and the second supply channel Rb2 and that guides, to the second supply channel Rb2, the ink supplied from the first communication channel Ra1. Although the sectional shape of the first supply channel Rb1 as viewed in the Y-axis direction is a trapezoid as illustrated in FIG. 3, the sectional shape is not limited thereto and may be any shape such as a rectangle or semicircle.

As illustrated in FIG. 3, the second supply channel Rb2 is provided in the communication plate 33. As illustrated in FIG. 3, the second supply channel Rb2 is a trapezoidal recess that extends in direction X1 and that is open toward direction Z1. The second supply channel Rb2 has a wall on one side in direction Z1 formed by a wall surface of the pressure chamber substrate 34 and has a wall on the other side in direction Z1 formed by a wall surface of the communication plate 33.

The second supply channel Rb2 is a channel that communicates with the first supply channel Rb1 and the pressure chamber Ca1 and that guides, to the pressure chamber Ca1, the ink supplied from the first supply channel Rb1. Although the sectional shape of the second supply channel Rb2 as viewed in the Y-axis direction is a trapezoid as illustrated in FIG. 3, the sectional shape is not limited thereto and may be any shape such as a rectangle or semicircle.

As illustrated in FIG. 3, width W1 of the second supply channel Rb2 in direction X1 is wider than width W2 of the first supply channel Rb1 in direction X1. Further, width W1 of the second supply channel Rb2 in direction X1 is narrower than width W3 of the pressure chamber Ca1 in direction X1.

As illustrated in FIG. 3, the second communication channel Ra2 is a space passing through the communication plate 33. The second communication channel Ra2 is a channel that extends in the Z-axis direction. The second communication channel Ra2 extends in direction Z1 and communicates with the pressure chamber Ca1 and the nozzle channel Nf. The second communication channel Ra2 is a channel that guides, to the nozzle channel Nf, the ink pushed out from the pressure chamber Ca1.

The nozzle channel Nf is a channel that is provided in the communication plate 33 and that extends in direction X1. The nozzle channel Nf is positioned between the pressure chamber Ca1 and the pressure chamber Ca2 as viewed in the Z-axis direction. The nozzle channel Nf communicates with the second communication channel Ra2 and the fourth communication channel Ra4 and includes the nozzle N for ejecting the ink supplied from the pressure chamber Ca1.

The third communication channel Ra3 is a space formed in the communication plate 33. Specifically, as illustrated in FIG. 3, the third communication channel Ra3 extends, in the Z-axis direction, from the space O22 that constitutes the second common liquid chamber R2 to the surface Fc2 of the communication plate 33. An end of the third communication channel Ra3, which is coupled to the space O22, is the end E2 of the individual channel P. The third communication channel Ra3 is a channel that communicates with the first discharge channel Rc1 and that guides, to the second common liquid chamber R2, the ink supplied from the first discharge channel Rc1.

As illustrated in FIG. 3, the first discharge channel Rc1 is provided in the pressure chamber substrate 34. The first discharge channel Rc1 is a space between the surface Fc2 of the communication plate 33 and the vibrating plate 35. The first discharge channel Rc1 is a channel that communicates with the third communication channel Ra3 and the second discharge channel Rc2 and that guides, to the third communication channel Ra3, the ink supplied from the second discharge channel Rc2. Although the sectional shape of the first discharge channel Rc1 as viewed in the Y-axis direction is a trapezoid as illustrated in FIG. 3, the sectional shape is not limited thereto and may be any shape such as a rectangle or semicircle.

As illustrated in FIG. 3, the second discharge channel Rc2 is provided in the communication plate 33. As illustrated in FIG. 3, the second discharge channel Rc2 is a trapezoidal recess that extends in direction X1 and that is open toward direction Z1. The second discharge channel Rc2 has a wall on one side in direction Z1 formed by a wall surface of the pressure chamber substrate 34 and has a wall on the other side in direction Z1 formed by a wall surface of the communication plate 33.

The second discharge channel Rc2 communicates with the first discharge channel Rc1 and the pressure chamber Ca2. The second discharge channel Rc2 is a channel that guides the ink, which is not ejected from the nozzle N, from the pressure chamber Ca2 to the first discharge channel Rc1. Although the sectional shape of the second discharge channel Rc2 as viewed in the Y-axis direction is a trapezoid as illustrated in FIG. 3, the sectional shape is not limited thereto and may be any shape such as a rectangle or semicircle.

As illustrated in FIG. 3, width W1 of the second discharge channel Rc2 in direction X1 is wider than width W2 of the first discharge channel Rc1 in direction X1. Further, width W1 of the second discharge channel Rc2 in direction X1 is narrower than width W3 of the pressure chamber Ca2 in direction X1.

As illustrated in FIG. 3, the fourth communication channel Ra4 is a space passing through the communication plate 33. The fourth communication channel Ra4 is a channel that extends in the Z-axis direction. The fourth communication channel Ra4 extends in direction Z1 and communicates with the pressure chamber Ca2 and the nozzle channel Nf. The fourth communication channel Ra4 is a channel that guides, to the pressure chamber Ca2, the ink supplied from the nozzle channel Nf.

According to the aforementioned configuration, during operation of the liquid ejecting apparatus 100, the liquid ejecting head 24 ejects the ink while causing the ink to circulate. Specifically, the ink from the liquid container 12 is supplied to the first common liquid chamber R1 via the supply channel 265. A drive section including the drive circuit 45 and the like then outputs a driving signal for driving a piezoelectric element 41 to the piezoelectric element 41 on the pressure chamber Ca1 side and the piezoelectric element 41 on the pressure chamber Ca2 side and thereby drives the piezoelectric element 41 on the pressure chamber Ca1 side and the piezoelectric element 41 on the pressure chamber Ca2 side at the same time. Thereby, the ink supplied to the first common liquid chamber R1 is ejected from the nozzle N. Moreover, of the ink supplied to the nozzle channel Nf, the ink that is not ejected from the nozzle N is supplied to the second common liquid chamber R2 via the third communication channel Ra3. Note that the aforementioned piezoelectric element 41 on the pressure chamber Ca1 side is an example of "a first energy-generating element", and the aforementioned piezoelectric element 41 on the pressure chamber Ca2 side is an example of "a second energy-generating element".

By causing the ink to circulate during ejection of the ink, the liquid ejecting head 24 of the first embodiment is able to suppress an increase in viscosity and precipitation of components of the ink near the nozzle N and prevent a deterioration in ejection characteristics of the ink. As a result, it is possible to keep the ejection characteristics of the ink substantially constant and improve ejection performance of the ink while suppressing a variation in the ejection characteristics. Note that the "ejection characteristics" described above are, for example, the ejection amount and ejection velocity of the ink.

Characteristics of the first embodiment will be described in detail below. Note that, in the following description, for simplification, the liquid ejecting head 24 illustrated in FIG. 3 will be described by referring to a range from the middle of the first common liquid chamber R1 to a portion immediately before the nozzle N. Although no particular description will be given for the other range, in particular, the downstream of the nozzle N in the direction in which the ink flows, a configuration of the upstream of the nozzle N in the direction in which the ink flows, which will be described later, is applicable to the downstream unless otherwise specified.

FIGS. 4A to 4C are plan views of the individual channel P as viewed in the Z-axis direction. FIGS. 4A to 4C illustrate three sections of a section along line IVA-IVA in FIG. 3 as a section of the first supply channel Rb1 and the pressure chamber Ca1 that overlap each other in the Z-axis direction, a section along line IVB-IVB in FIG. 3 as a section of the first communication channel Ra1, the second communication channel Ra2, and the second supply channel Rb2 that overlap each other in the Z-axis direction, and a section along line IVC-IVC in FIG. 3 as a section of the first common liquid chamber R1 and the nozzle channel Nf that overlap each other in the Z-axis direction.

Figures 5A, 5B, 5C:
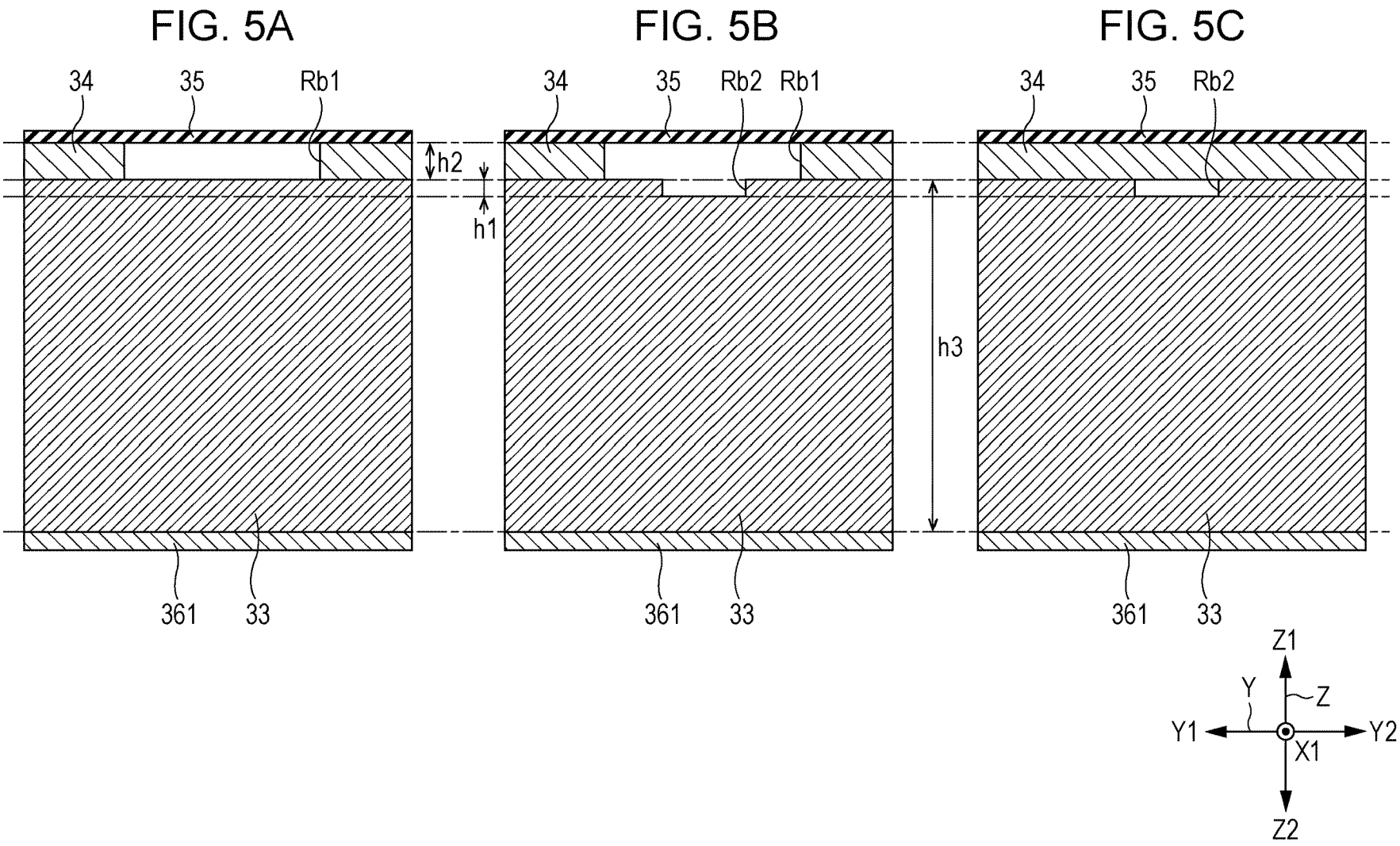

FIGS. 5A to 5C are side views of the individual channel P as viewed in the X-axis direction. FIGS. 5A to 5C illustrate three sections of a section along line VA-VA in FIG. 3 as a section passing through the first supply channel Rb1, a section along line VB-VB in FIG. 3 as a section of the first supply channel Rb1 and the second supply channel Rb2 that overlap each other in the X-axis direction, and a section along line VC-VC in FIG. 3 as a section passing through the second supply channel Rb2. Note that FIG. 5C illustrates the section along line VC-VC in FIG. 3 with illustration of the protection substrate 43 omitted.

As seen from FIGS. 4A to 4C, in the liquid ejecting head 24 of the first embodiment, the first common liquid chamber R1, the first communication channel Ra1, the second communication channel Ra2, the first supply channel Rb1, the pressure chamber Ca1, and the nozzle channel Nf each have a width in direction Y2 as width D2. Note that, although all the aforementioned components are described as having the same width D2, some of the components may have a different width.

On the other hand, as seen from FIGS. 4A to 4C, the second supply channel Rb2 of the liquid ejecting head 24 of the first embodiment has a width in direction Y2 as width D1. Here, width D1 is narrower than width D2.

Additionally, as seen from FIGS. 5A to 5C, in the liquid ejecting head 24 of the first embodiment, the first supply channel Rb1 provided in the pressure chamber substrate 34 has a width in direction Z1 as width h2. Note that, although not illustrated in FIGS. 5A to 5C, similarly, the pressure chamber Ca1 has a width in direction Z1 as width h2. Here, the pressure chamber substrate 34 also has a width in direction Z1 as width h2. That is, the first supply channel Rb1 and the pressure chamber Ca1 are provided so as to pass through the pressure chamber substrate 34.

On the other hand, as seen from FIGS. 5A to 5C, in the liquid ejecting head 24 of the first embodiment, the second supply channel Rb2 provided in the communication plate 33 has a width in direction Z1 as width h1. Here, width h1 is narrower than width h2. Here, the communication plate 33 has a width in direction Z1 as width h3. Width h3 is remarkably wider than width h1 and width h2. That is, the second supply channel Rb2 is formed so as to reduce a portion of the surface of the communication plate 33 without passing through the communication plate 33.

As seen from the foregoing, in the liquid ejecting head 24 of the first embodiment, the second supply channel Rb2 is smaller than the other components in both width in direction Y2 and width in direction Z1. Accordingly, higher processing accuracy is required for forming the second supply channel Rb2 compared with the other components. In view of this point, the liquid ejecting head 24 of the first embodiment is configured such that the second supply channel Rb2 is provided not in the pressure chamber substrate 34 but in the communication plate 33.

The reason for adopting such a configuration will be described. Not that, for simplification, the following description will be given with reference to only the second supply channel Rb2. Although no particular description will be given for the second discharge channel Rc2, since the second discharge channel Rc2 and the second supply channel Rb2 have the same configuration, the second discharge channel Rc2 exerts the operation effect similar to that of the second supply channel Rb2 described later.

As described above, in the first embodiment, width D1 of the second supply channel Rb2 in direction Y2 is narrower than width D2 of each of the first supply channel Rb1, the pressure chamber Ca1, the first communication channel Ra1, and the second communication channel Ra2 in direction Y2.

Here, frequency response of a liquid ejecting head generally depends on both channel resistance and inertance. In consideration of the frequency response, it is desirable to individually control the channel resistance and the inertance in a channel (hereinafter, referred to as "a supply port") proximate to a portion in which liquid is supplied to a pressure chamber. That is, it is not desirable that the channel resistance and the inertance are variable only equally. Note that the inertance refers to a ratio of pressure applied to ink by an energy-generating element relative to the acceleration of the ink caused by the pressure and relates to liquidity of the ink. When the inertance is small, the liquidity of the ink becomes high. Meanwhile, the channel resistance is a resistance component applied to the ink from a channel wall surface or the like while the ink flows.

The inertance is expressed by the following formula (1):

$$M=\mu L/\pi d^2 \quad (1)$$

where the inertance is M, the ink density is ρ, the channel length is L, and the channel sectional diameter is d.

The channel resistance is expressed by the following formula (2):

$$R=128\eta L/\pi d^4 \quad (2)$$

where the channel resistance is R, the ink viscosity is η, the channel length is L, and the channel sectional diameter is d.

The formulas (1) and (2) indicate that both the inertance M and the channel resistance R are proportional to one power of the channel length L. Thus, for example, an increase in channel length L results in not only an increase in inertance M but also an increase in channel resistance R equally. When the channel length L changes as described above, it is difficult to individually control the inertance M and the channel resistance R.

Meanwhile, the formulas (1) and (2) also indicate that the inertance M is inversely proportional to the square of the channel sectional diameter d and that the channel resistance R is inversely proportional to the fourth power of the channel sectional diameter d. That is, when the channel sectional diameter d changes, the inertance M and the channel resistance R are variable separately. Accordingly, when the channel sectional diameter d changes, it is possible to individually control the inertance M and the channel resistance R.

Meanwhile, for forming a channel in the pressure chamber substrate 34, the pressure chamber substrate 34 is subjected to a manufacturing process of thinning the pressure chamber substrate 34 by wafer grinding or the like and then causing a space to pass through the substrate by etching to thereby provide a pressure chamber C. After thinning, since even etching in a short time enables the space to pass through the substrate, the pressure chamber C is formed easily, but it is very difficult for a groove to be formed with a depth smaller than a thickness of the substrate. As a result, it is difficult for a channel of a desirable channel section dimeter d to be accurately formed in the pressure chamber substrate 34.

On the other hand, when a channel is provided in the communication plate 33, the communication plate 33 is not subjected to the aforementioned process of thinning, thus making it possible to perform etching on a substrate having a certain thickness. Accordingly, since a space is less likely to pass through the communication plate 33, the channel is more easily formed compared with when a space is formed by performing etching on the pressure chamber substrate 34, resulting in an accurate design of the channel sectional diameter d.

Note that, when trying to individually control the inertance M and the channel resistance R by changing a channel sectional diameter of the first communication channel Ra1 or the third communication channel Ra3, the following problem is caused. The channel length of the first communication channel Ra1 is obtained by subtracting the width in the Z-axis direction of a portion of the first common liquid chamber R1 that extends in the X-axis direction from the width of the communication plate 33 in the Z-axis direction, and the channel length of the third communication channel Ra3 is obtained by subtracting the width in the Z-axis direction of a portion of the second common liquid chamber R2 that extends in the X-axis direction from the width of the communication plate 33 in the Z-axis direction. That is, the channel length of the first communication channel Ra1 has a fixed value that depends on the communication plate 33 and the first common liquid chamber R1, and the channel length of the third communication channel Ra3 has a fixed value that depends on the communication plate 33 and the second common liquid chamber R2. As described above, since both the inertance M and the channel resistance R are proportional to one power of a channel length, when the channel length has a fixed value, the inertance M and the channel resistance R may not have desired values even by changing the channel sectional diameter. That is, it is not desirable to adjust the inertance M and the channel resistance R in accordance with a portion of the communication plate 33 that extends in the Z-axis direction as the thickness direction. Moreover, at least the first supply channel Rb1 and the first discharge channel Rc1 are provided respectively between the pressure chamber Ca1 and the first communication channel Ra1 and between the pressure chamber Ca2 and the third communication channel Ra3. Thus, even in a case in which the inertance M and the channel resistance R are adjusted to desired values in the first communication channel Ra1 and the third communication channel Ra3, when piezoelectric elements of the pressure chamber Ca1 and the pressure chamber Ca2 are driven, the first supply channel Rb1 and the first discharge channel Rc1 that are respectively closer than the first communication channel Ra1 and the third communication channel Ra3 to the pressure chamber Ca1 and the pressure chamber Ca2 function as buffers to a certain extent, resulting in the values deviating from the desired values. That is, it is not desirable to adjust the inertance M and the channel resistance R in a portion away from the pressure chamber Ca1 and the pressure chamber Ca2. As a result, in the present embodiment, the inertance M and the channel resistance R in the first communication channel Ra1 and the third communication channel Ra3 are not controlled.

In view of the foregoing, in the first embodiment, the second supply channel Rb2 whose channel sectional diameter d is smaller than those of the first supply channel Rb1, the pressure chamber Ca1, the first communication channel Ra1, and the second communication channel Ra2 is provided in the communication plate 33 near the pressure chamber Ca1. Providing in the communication plate 33 enables an accurate design of the channel sectional diameter as described above. Accordingly, it is possible to individually adjust the inertance and the channel resistance to desired values.

B: Second Embodiment

Figure 6:
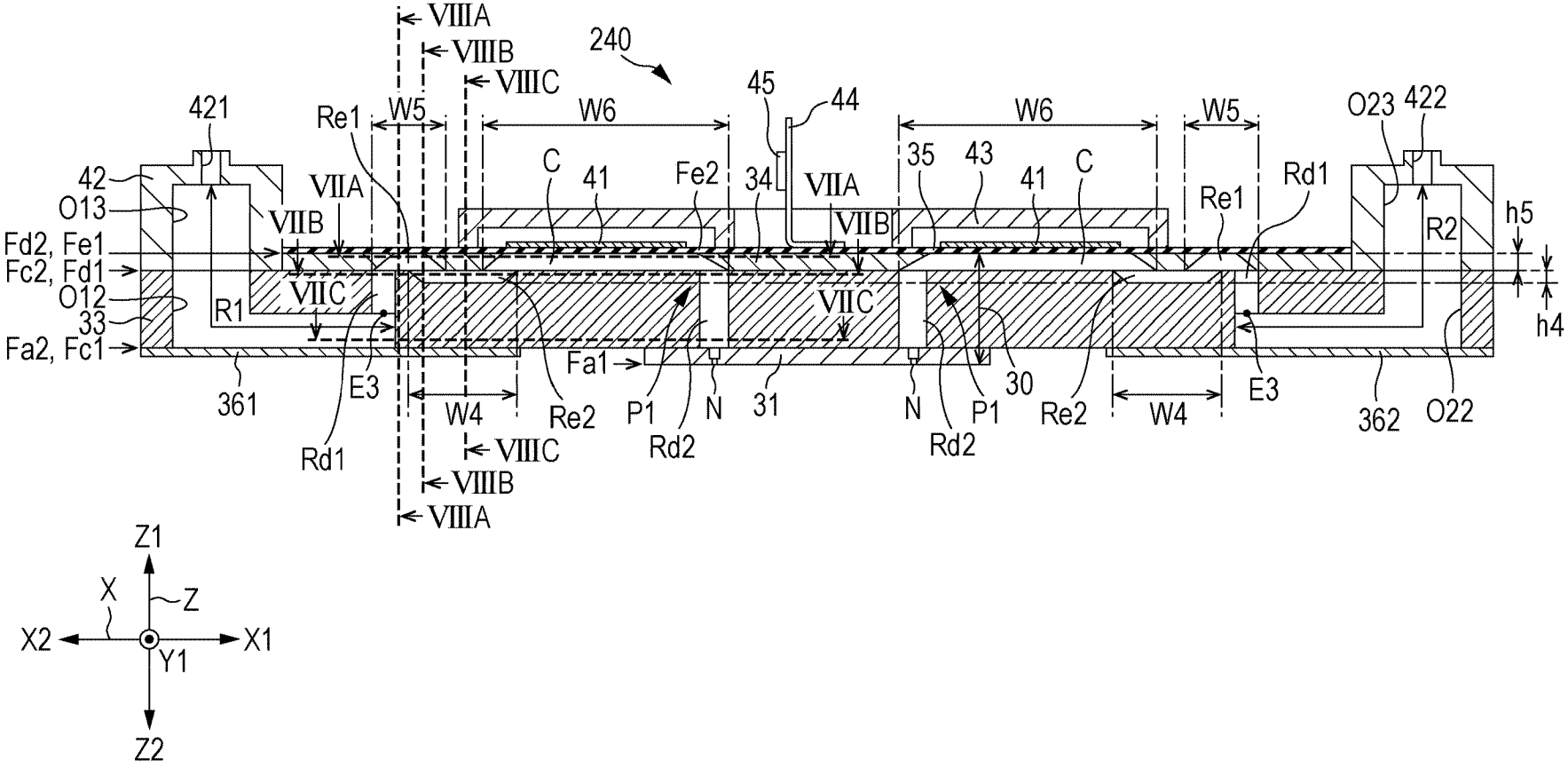
FIG. 6 is a sectional view illustrating an example of a configuration of a liquid ejecting head according to a second embodiment.

FIG. 6 is a sectional view illustrating an example of a configuration of a liquid ejecting head 240 according to a second embodiment. The first embodiment described above exemplifies a configuration in which the ink is caused to circulate from the second common liquid chamber R2 to the first common liquid chamber R1. On the other hand, in the second embodiment, the technical idea of causing the ink to circulate is omitted. That is, the liquid ejecting head 240 of the second embodiment differs from that of the first embodiment in that the circulation mechanism 26 is omitted. Note that configurations similar to those of the first embodiment will be given similar reference numerals, and description thereof will be omitted or simplified.

A plurality of individual channels P1 are formed in the communication plate 33 of the second embodiment. An individual channel P1 is formed in the communication plate 33 for each of the nozzles N. As illustrated in FIG. 6, the individual channel P1 includes a first communication channel Rd1, a first supply channel Re1, a second supply channel Re2, the pressure chamber C, and a second communication channel Rd2. The individual channel P1 is a channel in which the aforementioned elements are integrally formed. Each of the plurality of individual channels P1 is a channel formed to be plane symmetric with respect to a plane parallel to the Y-Z plane.

The first communication channel Rd1 is a space formed in the communication plate 33. Specifically, as illustrated in FIG. 6, the first communication channel Rd1 extends, in the Z-axis direction, from the space O12 that constitutes the first common liquid chamber R1 to the surface Fc2 of the communication plate 33. An end of the first communication channel Rd1, which is coupled to the space O12, is an end E3 of the individual channel P1. The first communication channel Rd1 is a channel that communicates with the first supply channel Re1 and that guides, to the first supply channel Re1, the ink supplied from the first common liquid chamber R1.

As illustrated in FIG. 6, the first supply channel Re1 is provided in the pressure chamber substrate 34. The first supply channel Re1 is a space between the surface Fc2 of the communication plate 33 and the vibrating plate 35. The first supply channel Re1 is a channel that communicates with the first communication channel Rd1 and the second supply channel Re2 and that guides, to the second supply channel Re2, the ink supplied from the first communication channel Rd1. Although the sectional shape of the first supply channel Re1 as viewed in the Y-axis direction is a trapezoid as illustrated in FIG. 6, the sectional shape is not limited thereto and may be any shape such as a rectangle or semicircle.

As illustrated in FIG. 6, the second supply channel Re2 is provided in the communication plate 33. As illustrated in FIG. 6, the second supply channel Re2 is a trapezoidal recess that extends in direction X1 and that is open toward direction Z1. The second discharge channel Re2 has a wall on one side in direction Z1 formed by a wall surface of the pressure chamber substrate 34 and has a wall on the other side in direction Z1 formed by a wall surface of the communication plate 33.

As illustrated in FIG. 6, width W4 of the second supply channel Re2 in direction X1 is wider than width W5 of the first supply channel Re1 in direction X1. Further, width W4 of the second supply channel Re2 in direction X1 is narrower than width W6 of the pressure chamber C in direction X1.

As illustrated in FIG. 6, the second communication channel Rd2 is a space passing through the communication plate 33. The second communication channel Rd2 is a channel that extends in the Z-axis direction. The second communication channel Rd2 extends in direction Z1 and communicates with the pressure chamber C and the nozzle N. The second communication channel Rd2 is a channel that guides, to the nozzle N, the ink pushed out from the pressure chamber C. The ink is ejected from the nozzle N.

Next, characteristics of the second embodiment will be described in detail below. Note that, in the following description, for simplification, the liquid ejecting head 240 illustrated in FIG. 6 will be described by referring to mainly the individual channel P1.

Figures 7A, 7B, 7C:
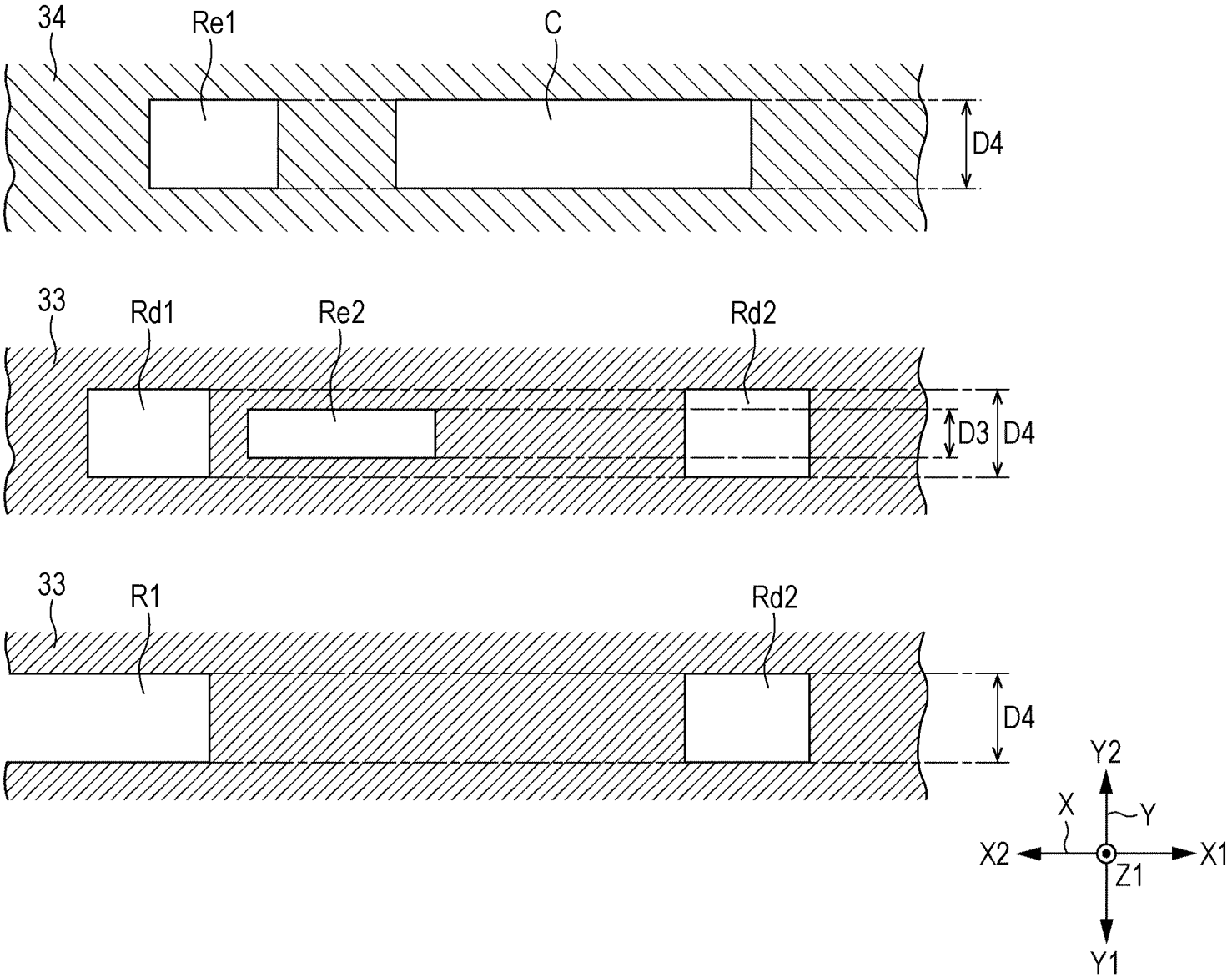

FIGS. 7A to 7C are plan views of the individual channel P1 as viewed in the Z-axis direction. FIGS. 7A to 7C illustrate three sections of a section along line VIIA-VIIA in FIG. 6 in the Z-axis direction as a section of the first supply channel Re1 and the pressure chamber C that overlap each other, a section along line VIIB-VIIB in FIG. 6 in the Z-axis direction as a section of the first communication channel Rd1, the second communication channel Rd2, and the second supply channel Re2 that overlap each other, and a section along line VIIC-VIIC in FIG. 6 in the Z-axis direction as a section of the first common liquid chamber R1 and the second communication channel Rd2 that overlap each other.

Figures 8A, 8B, 8C:
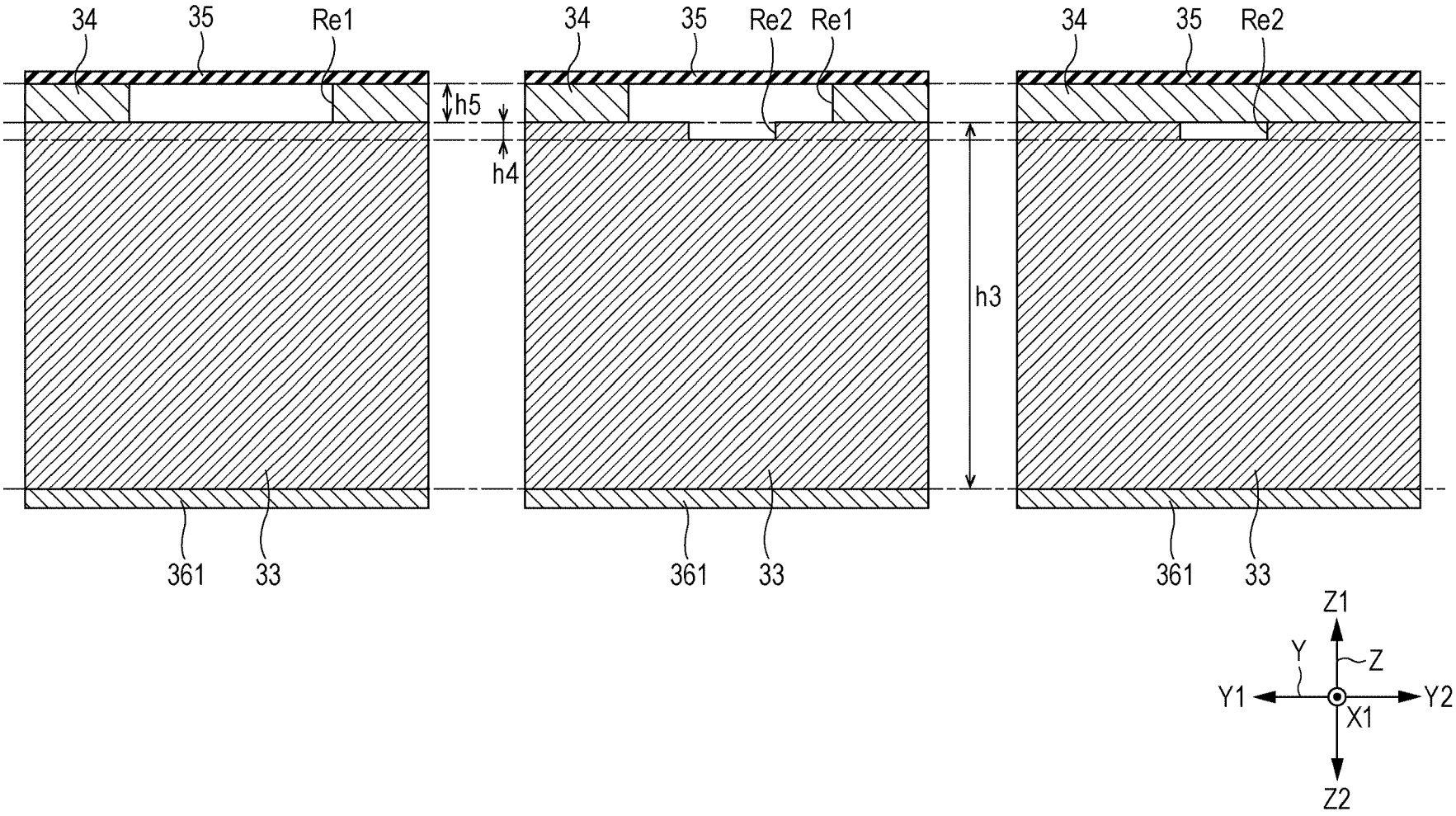

FIGS. 8A to 8C are side views of the individual channel P1 as viewed in the X-axis direction. FIGS. 8A to 8C illustrate three sections of a section along line VIIIA-VIIIA in FIG. 6 as a section passing through the first supply channel Re1, a section along line VIIIB-VIIIB in FIG. 6 in the X-axis direction as a section of the first supply channel Re1 and the second supply channel Re2 that overlap each other, and a section along line VIIIC-VIIIC in FIG. 6 as a section passing through the second supply channel Re2. Note that FIG. 8C illustrates the section along line VIIIC-VIIC in FIG. 6 with illustration of the protection substrate 43 omitted.

As seen from FIGS. 7A to 7C, in the liquid ejecting head 240 of the second embodiment, the first common liquid chamber R1, the first communication channel Rd1, the first supply channel Re1, the pressure chamber C, and the second communication channel Rd2 each have a width in direction Y2 as width D4. Note that, although all the aforementioned components are described as having the same width D4, some of the components may have a different width.

On the other hand, as seen from FIGS. 7A to 7C, the second supply channel Re2 of the liquid ejecting head 240 of the second embodiment has a width in direction Y2 as width D3. Here, width D3 is narrower than width D4.

Additionally, as seen from FIGS. 8A to 8C, in the liquid ejecting head 240 of the second embodiment, the first supply channel Re1 provided in the pressure chamber substrate 34 has a width in direction Z1 as width h5. Note that, although not illustrated in FIGS. 8A to 8C, similarly, the pressure chamber C has a width in direction Z1 as width h5. Here, the pressure chamber substrate 34 also has a width in direction Z1 as width h5. That is, the first supply channel Re1 and the pressure chamber C are provided so as to pass through the pressure chamber substrate 34.

On the other hand, as seen from FIGS. 8A to 8C, in the liquid ejecting head 240 of the second embodiment, the second supply channel Re2 provided in the communication plate 33 has a width in direction Z1 as width h4. Here, width h4 is narrower than width h5. Here, the communication plate 33 has a width in direction Z1 as width h3. Width h3 is remarkably wider than width h4 and width h5. That is, the second supply channel Re2 is formed so as to reduce a portion of the surface of the communication plate 33 without passing through the communication plate 33.

As seen from the foregoing, in the liquid ejecting head 240 of the second embodiment, the second supply channel Re2 is smaller than the other components in both width in direction Y1 and width in direction Z1. Accordingly, higher processing accuracy is required for forming the second supply channel Re2 compared with the other components. In view of this point, the liquid ejecting head 240 of the second embodiment is configured such that the second supply channel Re2 is provided not in the pressure chamber substrate 34 but in the communication plate 33, similarly to the first embodiment. As a result, similarly to the first embodiment, it is possible to accurately design the channel sectional diameter of the second supply channel Re2 and individually adjust the inertance and the channel resistance in the supply port to desired values.

C: Modified Examples

Although the embodiments of the disclosure have been described above, the disclosure is not limited to the embodiments described above, and various modifications can be added. Specific modified aspects that can be added to the aforementioned aspects will be exemplified below. Any aspects selected from the following examples may be appropriately combined as long as the aspects do not contradict each other.

(1) The energy-generating element that changes the pressure of the ink in the pressure chamber C is not limited to the piezoelectric element 41 exemplified in the aforementioned aspect. For example, a heating element that generates air bubbles in the pressure chamber C by heating and thereby changes the pressure of the ink may be used as the energy-generating element.

(2) Although the liquid ejecting apparatus 100 of a serial type in which the transport body 231 on which the liquid ejecting head 24 or 240 is mounted is reciprocated has been exemplified in the aforementioned aspect, the disclosure is applicable to a liquid ejecting apparatus of a line type in which a plurality of nozzles N are distributed over the entire width of the medium 11.

D: Supplemental Note

The configuration of the liquid ejecting apparatus 100 is not limited to the configurations exemplified in FIGS. 2 to 8C, and a general liquid ejecting apparatus which causes the ink to circulate and which has a configuration different from the configurations illustrated in the drawings may be used, for example. Further, the liquid ejecting apparatus 100 exemplified in the aforementioned aspect may be adopted for various apparatuses such as a facsimile apparatus and a copying machine in addition to equipment dedicated to printing, and the use of the disclosure is not particularly limited. Needless to say, the liquid ejecting apparatus is not limited to being used for printing. For example, a liquid ejecting apparatus that ejects a solution of a color material is used as a manufacturing apparatus that forms a color filter of a display apparatus such as a liquid crystal display panel. Further, a liquid ejecting apparatus that ejects a solution of a conductive material is used as a manufacturing apparatus that forms a wire and an electrode of a wiring substrate. In addition, a liquid ejecting apparatus that ejects an organic solution regarding a living body is used as a manufacturing apparatus that manufactures a biochip, for example.

Additionally, the effects described herein are merely demonstrative or illustrative and are not limited. In other words, the disclosure can exhibit other effects obvious to a person skilled in the art from the descriptions herein together with or in place of the aforementioned effects.

Although the suitable embodiments of the disclosure have been described in detail above with reference to the accompanying drawings, the disclosure is not limited to such examples. It is apparent that a person having ordinary skill in the art of the disclosure can conceive of various modifications and alterations within the range of the technical ideas that are described in claims, and of course, such modifications and alterations are understood as falling within the technical scope of the disclosure.

E: Additional Note

For example, the following configurations are derivable from the aspects exemplified above.

A liquid ejecting head according to an aspect 1 that is an aspect of the disclosure includes: a pressure chamber substrate; and a communication plate, in which the pressure chamber substrate includes a first pressure chamber that extends in a first direction and applies pressure to a liquid, and a first supply channel, and the communication plate includes a first communication channel that extends in a second direction intersecting with the first direction and communicates with the first supply channel, and a second supply channel that communicates with the first supply channel and the first pressure chamber. According to the aspect, it is possible to individually adjust the inertance and the channel resistance to desired values.

According to an aspect 2 that is a specific example of the aspect 1, a width of the second supply channel in the second direction may be narrower than a width of the first supply channel in the second direction.

According to an aspect 3 that is a specific example of the aspect 1 or 2, a width of the second supply channel in the second direction may be narrower than a width of the first pressure chamber in the second direction.

According to an aspect 4 that is a specific example of any of the aspects 1 to 3, a width of the second supply channel in a third direction intersecting with both the first direction and the second direction may be narrower than a width of the first supply channel in the third direction.

According to an aspect 5 that is a specific example of any of the aspects 1 to 4, a width of the second supply channel in a third direction intersecting with both the first direction and the second direction may be narrower than a width of the first pressure chamber in the third direction.

According to an aspect 6 that is a specific example of any of the aspects 1 to 5, a width of the second supply channel in a third direction intersecting with both the first direction and the second direction may be narrower than a width of the first communication channel in the third direction.

According to an aspect 7 that is a specific example of any of the aspects 1 to 6, a nozzle substrate in which a nozzle for ejecting the liquid is provided may be further included, and a second communication channel that extends in the second direction and communicates with the first pressure chamber and the nozzle may be provided in the communication plate.

According to an aspect 8 that is a specific example of the aspect 7, a width of the second supply channel in a third direction intersecting with both the first direction and the second direction may be narrower than a width of the second communication channel in the third direction.

According to an aspect 9 that is a specific example of any of the aspects 1 to 8, a width of the second supply channel in the first direction may be wider than a width of the first supply channel in the first direction.

According to an aspect 10 that is a specific example of any of the aspects 1 to 9, a width of the second supply channel in the first direction may be narrower than a width of the first pressure chamber in the first direction.

According to an aspect 11 that is a specific example of any of the aspects 1 to 10, the second supply channel may have a wall on one side in the second direction formed by a wall surface of the pressure chamber substrate and have a wall on another side in a direction opposite to the second direction formed by a wall surface of the communication plate.

According to an aspect 12 that is a specific example of any of the aspects 1 to 11, a reservoir that extends in the first direction, communicates with the first communication channel, and accumulates the liquid may be further included.

According to an aspect 13 that is a specific example of any of the aspects 1 to 12, a second pressure chamber that extends in the first direction and applies pressure to the liquid, a first energy-generating element that, upon being applied of a driving voltage, generates energy for applying pressure to the liquid in the first pressure chamber, and a second energy-generating element that, upon being applied of a driving voltage, generates energy for applying pressure to the liquid in the second pressure chamber may be further included.

A liquid ejecting apparatus according to an aspect 14 that is an aspect of the disclosure may include the liquid ejecting head according to any of the aspects 1 to 13, and a control section that controls ejection operation of the liquid ejecting head.

What is claimed is:

1. A liquid ejecting head comprising:

a pressure chamber substrate; and a communication plate, wherein the pressure chamber substrate includes a plurality of pressure chambers including a first pressure chamber that extends in a first direction and applies pressure to a liquid and a first supply channel, and the communication plate includes a first communication channel that extends in a second direction intersecting with the first direction and communicates with the first supply channel and a second supply channel, and wherein the first supply channel communicates individually with the first pressure chamber via the second supply channel that communicates individually with the first pressure chamber.

2. The liquid ejecting head according to claim 1, wherein a width of the second supply channel in the second direction is narrower than a width of the first supply channel in the second direction.

3. The liquid ejecting head according to claim 1, wherein a width of the second supply channel in the second direction is narrower than a width of the first pressure chamber in the second direction.

4. The liquid ejecting head according to claim 1, wherein a width of the second supply channel in a third direction intersecting with both the first direction and the second direction is narrower than a width of the first supply channel in the third direction.

5. The liquid ejecting head according to claim 1, wherein a width of the second supply channel in a third direction intersecting with both the first direction and the second direction is narrower than a width of the first pressure chamber in the third direction.

6. The liquid ejecting head according to claim 1, wherein a width of the second supply channel in a third direction intersecting with both the first direction and the second direction is narrower than a width of the first communication channel in the third direction.

7. The liquid ejecting head according to claim 1 further comprising a nozzle substrate in which a nozzle for ejecting the liquid is provided, and a second communication channel that extends along the second direction in the communication plate, wherein the second communication channel communicates with the first pressure chamber and the nozzle.

8. The liquid ejecting head according to claim 7, wherein a width of the second supply channel in a third direction intersecting with both the first direction and the second direction is narrower than a width of the second communication channel in the third direction.

9. The liquid ejecting head according to claim 1, wherein a width of the second supply channel in the first direction is wider than a width of the first supply channel in the first direction.

10. The liquid ejecting head according to claim 1, wherein a width of the second supply channel in the first direction is narrower than a width of the first pressure chamber in the first direction.

11. The liquid ejecting head according to claim 1, wherein the second supply channel has a wall on one side in the second direction formed by a wall surface of the pressure chamber substrate and has a wall on another side in a direction opposite to the second direction formed by a wall surface of the communication plate.

12. The liquid ejecting head according to claim 1 further comprising a reservoir that extends in the first direction, communicates with the first communication channel, and accumulates the liquid.

13. The liquid ejecting head according to claim 1 further comprising:

a second pressure chamber that extends in the first direction and applies pressure to the liquid;

a first energy-generating element that, upon being applied of a driving voltage, generates energy for applying pressure to the liquid in the first pressure chamber; and a second energy-generating element that, upon being applied of a driving voltage, generates energy for applying pressure to the liquid in the second pressure chamber.

14. A liquid ejecting apparatus comprising:

the liquid ejecting head according to claim 1; and a control section that controls ejection operation of the liquid ejecting head.

15. The liquid ejecting head of claim 1, wherein the first communication channel communicates individually with the first supply channel.

16. The liquid ejecting head according to claim 2, the communication plate further includes a first common liquid chamber that communicates with the first communication channel, wherein the first common liquid chamber supplies the liquid to the plurality of pressure chambers.

17. The liquid ejecting head according to claim 1, wherein the pressure chamber substrate is thinner than the communication plate in the second direction.

* * * * *